United States Patent [19]

Bennett

[11] Patent Number: 5,046,988

[45] Date of Patent: Sep. 10, 1991

[54] LINKED POLYHEDRA WITH CORNER CONNECTOR

[76] Inventor: Herbert G. Bennett, 195 E. 31st St., Brooklyn, N.Y. 11226

[21] Appl. No.: 435,239

[22] Filed: Nov. 13, 1989

[51] Int. Cl.[5] ..... A63H 33/00; A63H 33/08; A63F 9/08

[52] U.S. Cl. ..... 446/487; 446/108; 446/116; 273/159; 52/DIG. 10; 402/294

[58] Field of Search ..... 446/85, 119, 102, 104, 446/107, 108, 109, 116, 487, 488, 489, 490, 486; 273/157 R, 159, 160; 52/DIG. 10; 402/294, 295

[56] References Cited

U.S. PATENT DOCUMENTS

| | | | |
|---|---|---|---|
| 3,201,894 | 8/1965 | Resch | 446/487 |
| 3,222,072 | 12/1965 | Dreyer | 275/157 R |
| 3,487,578 | 1/1970 | Sudermann | 446/487 |
| 3,550,310 | 12/1970 | Bock-Greissau | 446/85 |
| 3,577,673 | 5/1971 | Monestier | 446/490 |
| 3,596,396 | 8/1971 | Thomson | 446/487 |
| 3,611,620 | 10/1971 | Perry | 52/DIG. 10 X |
| 3,648,404 | 3/1972 | Ogbury et al. | 446/126 |
| 3,747,261 | 7/1973 | Salem | 446/104 |
| 3,774,332 | 11/1973 | Schneider | 40/152.1 |
| 3,822,499 | 7/1974 | DeVos | 446/121 |
| 3,836,418 | 9/1974 | Montgomery | 446/487 |
| 4,325,552 | 4/1982 | Glasheen | 273/157 R X |
| 4,471,595 | 9/1984 | Lanzafame | 52/584 |
| 4,492,723 | 1/1985 | Chadwick | 428/7 |
| 4,871,080 | 10/1989 | Bennett | 220/1 R |
| 4,875,681 | 10/1989 | Ofir | 273/155 |

FOREIGN PATENT DOCUMENTS

| | | | |
|---|---|---|---|
| 8000541 | 4/1980 | Denmark | 446/102 |
| 0185628 | 6/1986 | European Pat. Off. | 273/160 |
| 576917 | 5/1933 | Fed. Rep. of Germany . | |
| 808568 | 7/1951 | Fed. Rep. of Germany . | |
| 7005541 | 2/1970 | Fed. Rep. of Germany | 446/119 |
| 3536996 | 3/1986 | Fed. Rep. of Germany | 52/DIG. 10 |
| 83065 | 4/1975 | Sweden . | |

*Primary Examiner*—Robert A. Hafer
*Assistant Examiner*—D. Neal Muir
*Attorney, Agent, or Firm*—Pennie & Edmonds

[57] ABSTRACT

A transformable combination of linked polyhedra which includes a set of a plurality of objects each having at least first and second faces and a member for connecting adjacent objects in a manner which allows rotation of one object while an adjacent object is fixed so that the position of the first and second faces of the one object can be changed with respect to the position of the adjacent object. Preferably, the connecting member is a corner connector which includes a straight or bent rod member having first and second rotatable end members which facilitate rotation of the objects. Also, a single continuous connecting member may be used to join all objects in the set.

35 Claims, 6 Drawing Sheets

LINKED POLYHEDRA WITH CORNER CONNECTOR

TECHNICAL FIELD

The invention relates to a set of a plurality of three dimensional objects which are connected in a manner such that individual objects can be rotated relative to the other objects to transpose the surfaces of the objects and create different appearances for the set. The invention also relates to a preferred connector for such objects and a method for transforming the surfaces of such objects to change the appearance of the set.

SUMMARY OF THE INVENTION

The invention relates to a transformable combination of a first set of objects comprising a first object having first and second outer surfaces; a second object having first and second outer surfaces; and means for connecting the first and second objects in a manner which allows rotation of the first object relative to the second object so that the position of the first and second outer surfaces of the first object can be changed with respect to the second object, wherein the first and second objects each have no more than one additional connection to another object in the set.

This combination may also include a third object having first and second outer surfaces adjacent the second object, and means for connecting the third object to the second object in a manner which allows rotation of the second object relative to the third object is fixed so that the position of the first and second surfaces of the second object can be changed with respect to the third object. In addition, a fourth object having first and second outer surfaces may be provided adjacent the third object, with means for connecting the fourth object to the third object in a manner which allows rotation of the third object relative to the fourth object so that the position of the first and second surfaces of the third object can be changed with respect to the fourth object. Preferably, the combination includes means for connecting the fourth object to the first object in a manner which allows rotation of the fourth object relative to the first object so that the position of the first and second surfaces of the fourth object can be changed with respect to the fourth object.

Each of the objects may be connected by a continuous element, such as a resilient filament which allows the spacing between adjacent objects to be increased by stretching of the filament. Also, the continuous element may be a filament which includes means for elongating the continuous element to increase the spacing between adjacent objects. The elongating means preferably comprises spring means located in at least one of the objects. It is also contemplated that the connecting means may be a rigid or flexible rod member having first and second ends of larger cross-sectional area than the rod member, with the first and second ends positioned within the first and second objects, respectively, for maintaining a rotatable connection there between. A similar rod member can be used to interconnect the other objects together.

The objects may have more than two surfaces. In a preferred embodiment, the first and second objects each have at least first, second and third outer faces and further wherein the position of the faces of the second object can be changed with respect to the position of the faces of the first object. Three dimensional objects having one or more degrees of symmetry are preferred, such as equilateral polyhedrons and more specifically, cubes. The objects are thus connected at a corner of each cube by connecting means extending diagonally therethrough. In addition, objects having top and bottom faces and a number of inwardly facing sides can be used. Generally, the number of sides will be equal to a multiple of 4. Instead, polyhedrons having at least six faces can also be used, with symmetric polyhedrons being preferred.

Another embodiment of the invention relates to a transformable combination including a first set of objects comprising first, second, third and fourth three dimensional polyhedrons each having at least two faces and a number of sides equal to a multiple of four; and means connecting each of the polyhedrons and extending through opposite corners thereof so that each polyhedron can be rotated with respect to adjacent polyhedrons to change the position of the faces of the rotated polyhedron.

Finally, the invention also relates to a connector for joining objects together as well as to a method for transposing the surfaces of objects in a set by connecting the objects as described above and by rotating one or more of the objects so that the position of outer surfaces can be exchanged to transform the appearance of the set of objects.

BRIEF DESCRIPTION OF THE DRAWINGS

A further understanding of the present invention can be had with reference to the attached drawing figures, wherein.

DETAILED DESCRIPTION OF THE PREFERRED EMBODIMENTS

Figure 1:
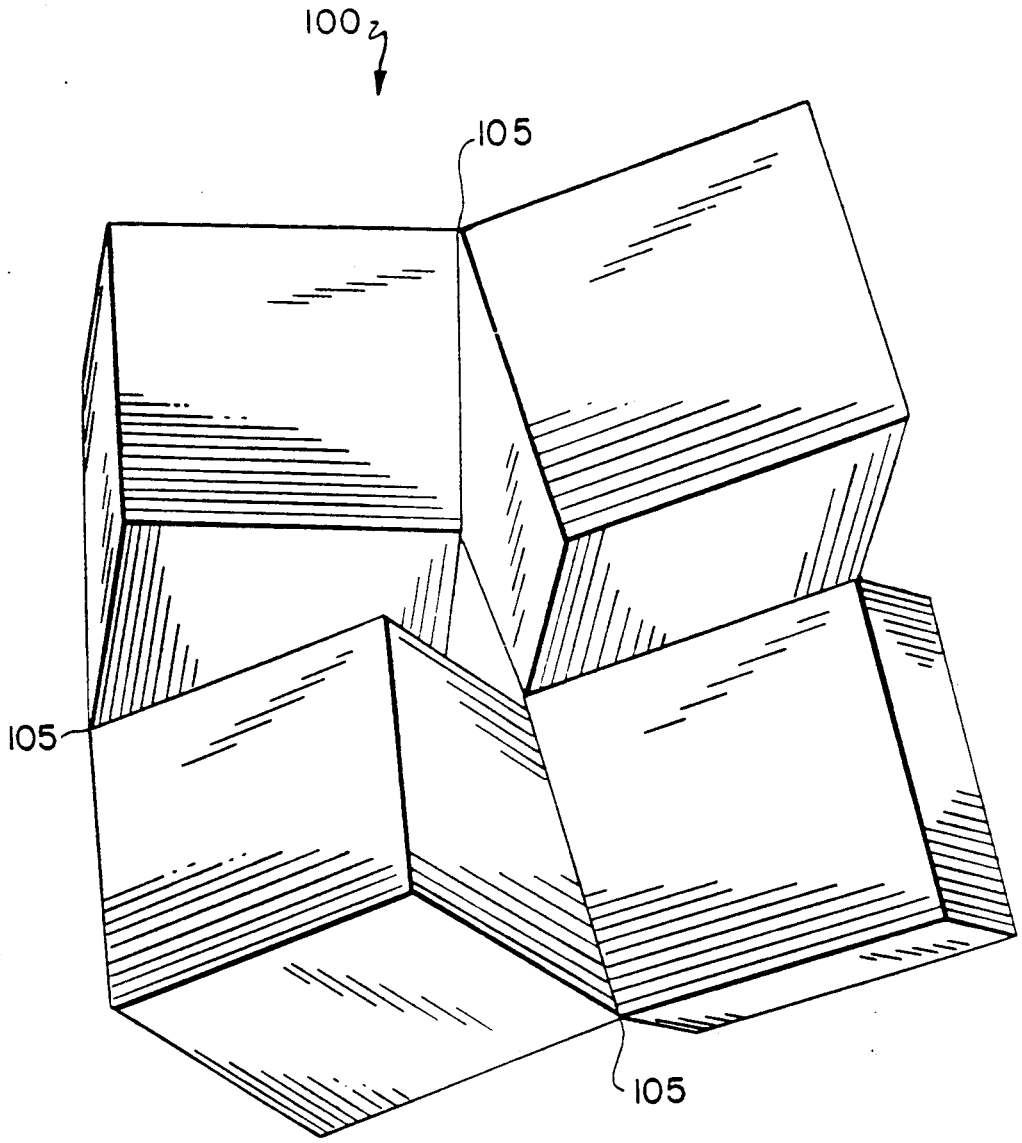
FIG. 1 is a perspective view of a set of four blocks according to the invention.

Referring initially to FIG. 1, there is illustrated a transformable combination of a set 100 of four cubes. These cubes are connected at adjacent corner vertices 105 by a filament that passes through opposite corners of the cube of each of the cubes. As will be described below, the filament has sufficient flexibility, or includes a means which allow its elongation, so that the cubes may be separated sufficiently to permit rotation of the faces which contact the corner point where the connecting filament passes therethrough. This filament only passes through two opposite corners of any one cube so as to facilitate rotation of the faces of one cube with respect to the faces of adjacent cubes. The corner of a cube has three faces extending away from the corner, each at an 90 degree angle with respect to the other. Thus, as the cube is rotated, any one of these three faces may be presented in adjacent position to the face of an adjacent cube.

Figure 2:
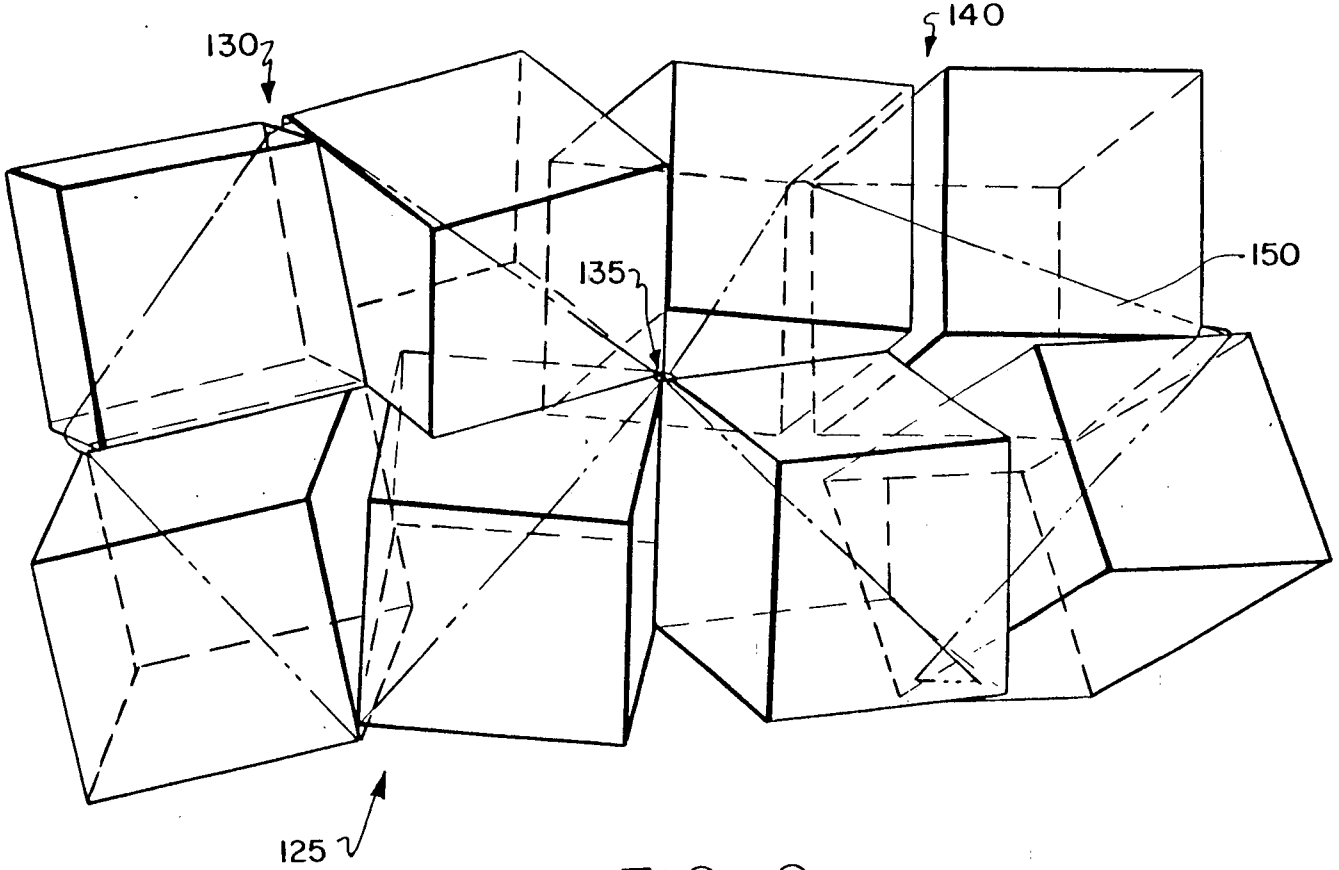
FIG. 2 is a perspective view for an eight block combination having a first set of four blocks and a second set of four blocks.

Referring now to FIG. 2, there is illustrated a transformable combination 125 which includes a first set of four cubes 130 and a second set of four cubes 140. As in FIG. 1, these cubes are connected by an internal filament 150 extending through adjacent corners thereof, with an additional connection point 135 for joining the first set of cubes 130 to the second set of cubes 140. The filament 150 is shown in a stretched or elongated state for providing space between the corners of adjacent cubes to facilitate rotation of the faces.

Figure 3:
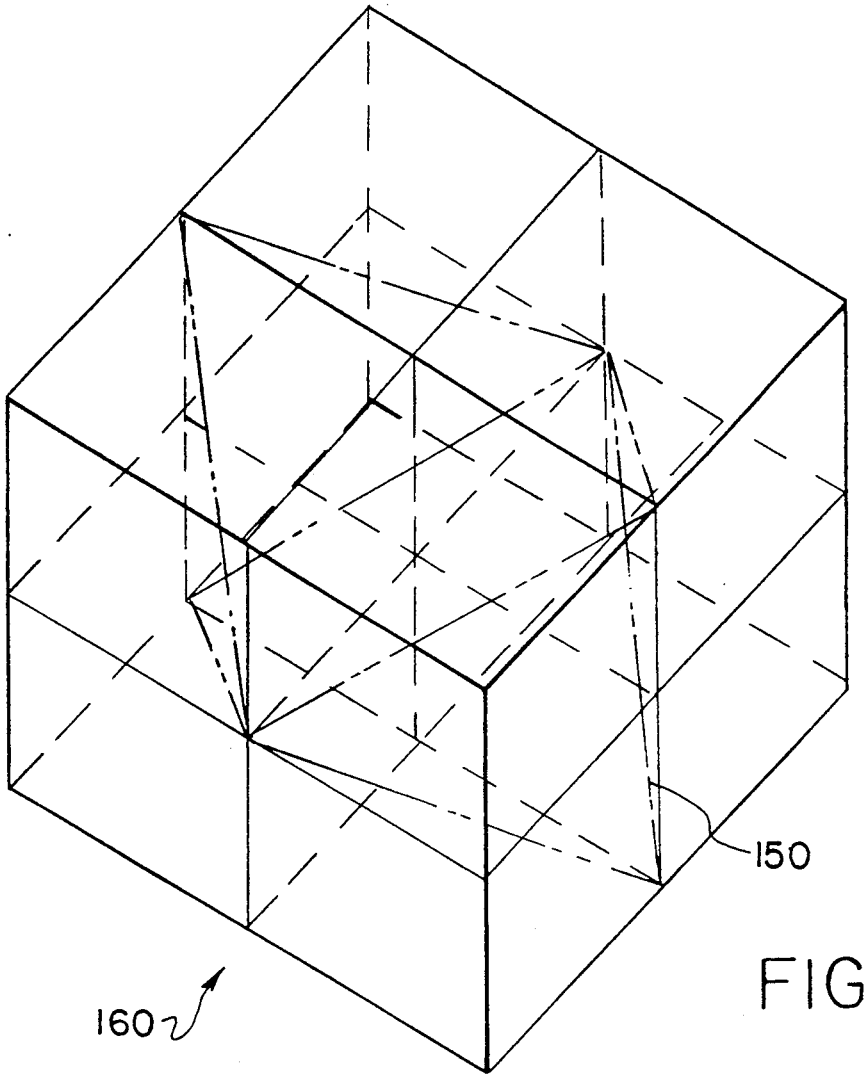
FIG. 3 is a perspective view of the combination of FIG. 2 in a cubic arrangement.

FIG. 3 illustrates the combination of FIG. 2 wherein each of the blocks is rotated so as to be in the closest adjacent space relationship with each other block thus forming a large cube 160. Each of the faces of the individual cubes can be rotated so that two additional faces may be presented in the position where the original face is shown in the Figure. In addition to the rotation of the faces, these cubes may be aligned to form a wall of two rows (upper and lower) of four blocks each. Accordingly, a wide variety of different appearances can be made for any of the faces of the cubes used to form the combination 160. It can be appreciated that this ability to transform the faces of the individual cubes allows a wide variety of games, advertisements, packaging and the like to be provided by the present invention.

The element 150 which is used for joining the objects is preferably a thermoplastic monofilament material typically used for joining leather goods or for other applications such as fishing line. This material is sufficiently rigid yet provides a degree of elongation so that the cube may be separated prior to rotation of faces thereof. In addition, other materials can be used for this connecting element. String, yarn, thread, or elastomers can also be used to achieve the same results described above. If desired, metal wire or the like can be used, provided that sufficient slack is present so that the cubes may be rotated.

Figure 4:
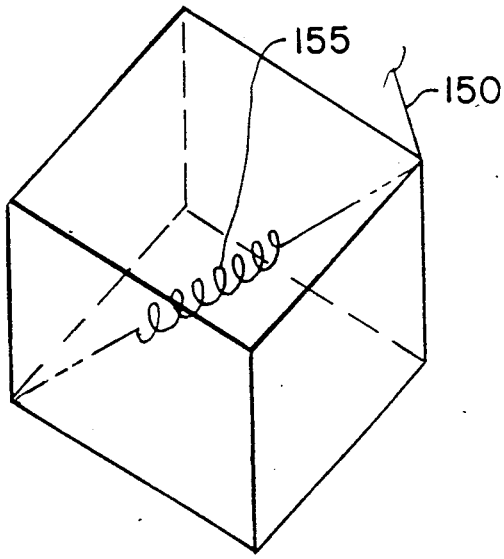
FIG. 4 is a view of a single block according to the invention to illustrate a spring component of the connecting means.

FIG. 4 shows an alternate embodiment of a relatively rigid connector element 150, such as metal wire. In this figure, a spring 155 is positioned within at least one cube so as to provide elongation of the connector element 150 so that the cubes may be separated and rotated. The ends of the spring 155 are connected to the metal wire connector element 150, which then passes through adjacent corners of the cubes described above. If desired, for greater tension, a spring element 155 can be provided in one or more additional cubes. The greatest tension is obtained when all cubes each include a spring element 155.

Figure 5:
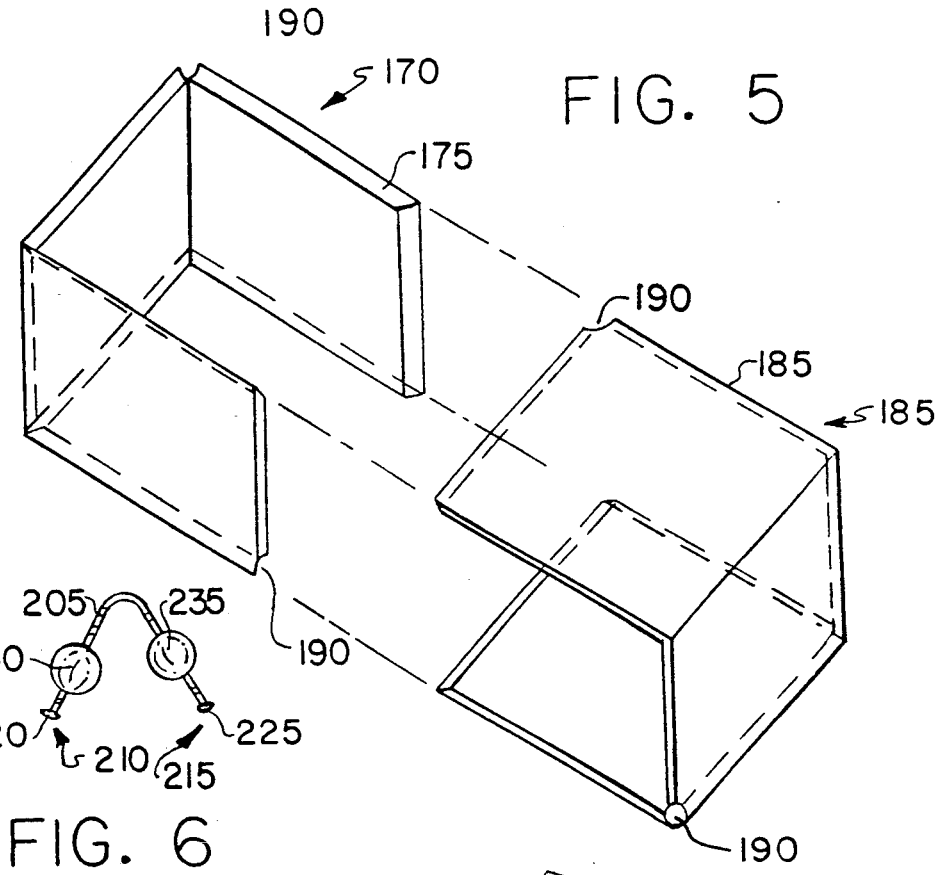
FIG. 5 is an illustration of one way for assembling the blocks of the invention.

Referring now to FIG. 5, there is illustrated one way for assembling the cubes of the invention. First cube portion 170 is provided with bevelled edges 170 on each of the edges of the cube which is to mate with a second cube portion 180. Similarly, cube 180 has bevelled portion 185 again for mating with the edges of the first portion 170. These cube portions can be identical in size, shape and dimension so that they can be made from a single mold. The cube portions are interconnected by sliding one into the other as shown. While a friction fit may be suitable for some applications, the cubes may be more permananetly joined by welding, gluing or the like, depending upon the specific material used for the cube portions. It is preferable for the corner portions 190 of the cube parts 170, 180 where the filament must extend to be removed to facilitate such passage. As noted above, the apertures formed by these removed corner portions 190 are provided on opposite corners of the cube.

Figure 8:
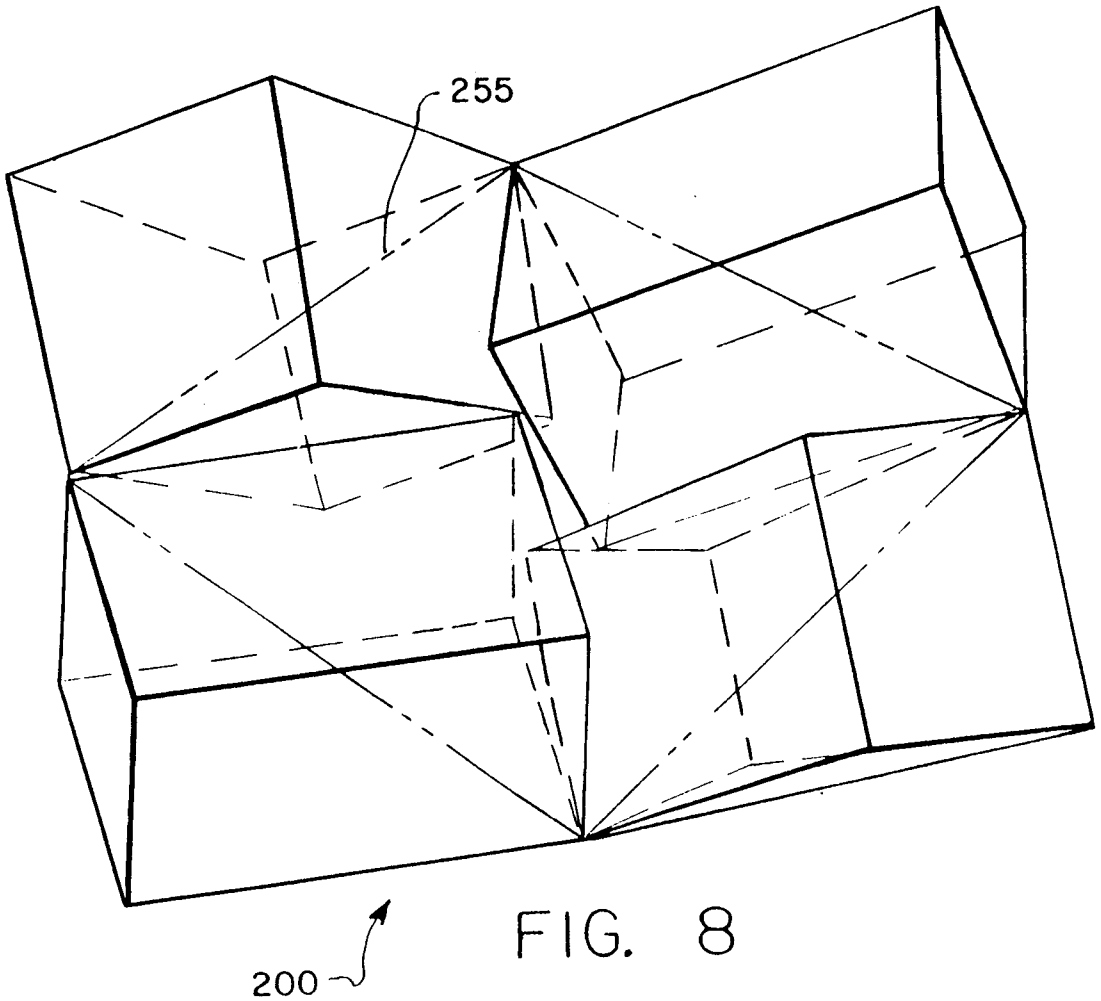
FIG. 8 is a perspective view of a set of four elongated blocks according to the invention.

It is also possible to injection mold the cubes in the desired size with corner apertures formed therein. Instead, the cube can be molded followed by cutting the apertures therein. A further method for making additional three dimensional cubes involves the utilization of flat flexible elements which are inscribed with the cube design, folded along the inscribed lines and folded into the shape of the three dimensional object. In this regard, the methods and objects disclosed in the inventor's U.S. Pat. No. 4,871,080 are useful in accordance with the teachings of the present invention, and the content of that patent application is expressly incorporated herein by reference thereto. FIG. 8 is an illustrative embodiment of a preferred object according to the inventor's earlier patent application.

While hollow three dimensional objects are specifically disclosed, it is also possible to utilize solid objects having an interior channel for passage of the connecting element. Alternatively, the connector of FIG. 6 could be utiilized with such solid objects provided that the respective corners of the objects are provided with the "socket" portion of a ball and socket type joint, with the connector described below in FIG. 6 used as the "ball" portion of the joint.

Figure 6:
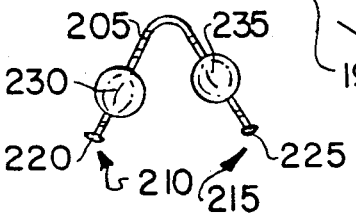
FIG. 6 is a view of a preferred connector for joining the blocks according to the invention.
Figure 7:
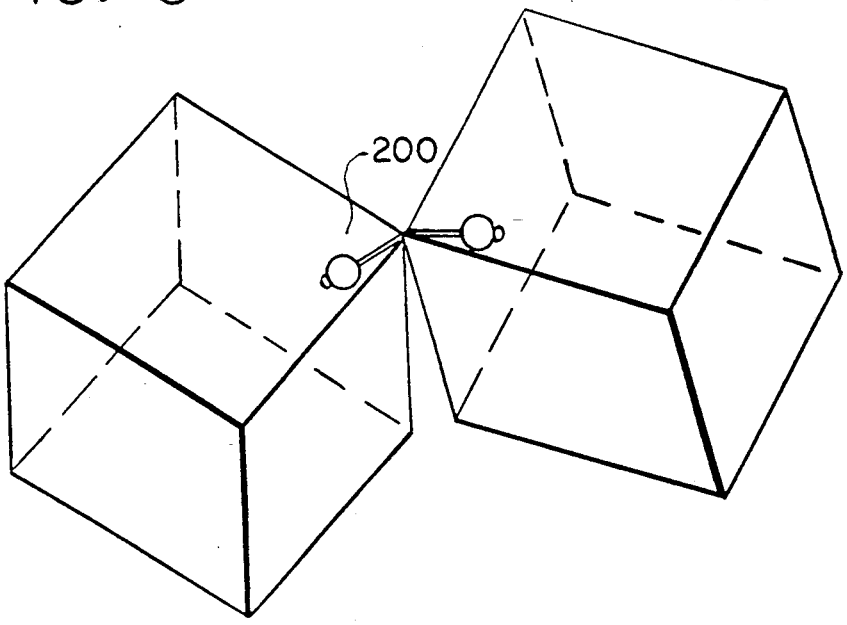
FIG. 7 is a view of the connector of FIG. 6 in position between adjacent blocks.

Referring now to FIGS. 6 and 7, there is illustrated an alternative connector member 200 for joining adjacent cubes. This connector member 200 includes an angled rod member 205 having two ends 210, 215 which include stop members 220, 225 for retaining two spherical rotatable objects 230, 235 thereon. The spherical objects 230, 235 of the connector 200 are capable of rapidly and easily rotating around the rod member, 205 to allow the cube faces to be easily and rapidly manipulated. These spherical objects 230, 235, in combination with the stop members 220, 225 of the angled rod member 205 provide the maximum spacing between adjacent connected cubes.

The rod member 205 may be rigidly made in a bent configuration, as shown in FIG. 6, but it may also be made of a flexible material which is capable of being bent into the desired configuration.

A wide variety of additional shapes other than cubes can be used according to the invention. In one embodiment as shown in FIG. 8, a set 250 of rectangular boxes can be rotated in the same manner as the cubes discussed above. In this embodiment, the boxes are again connected at opposite corners by connecting element 255.

Figure 9:
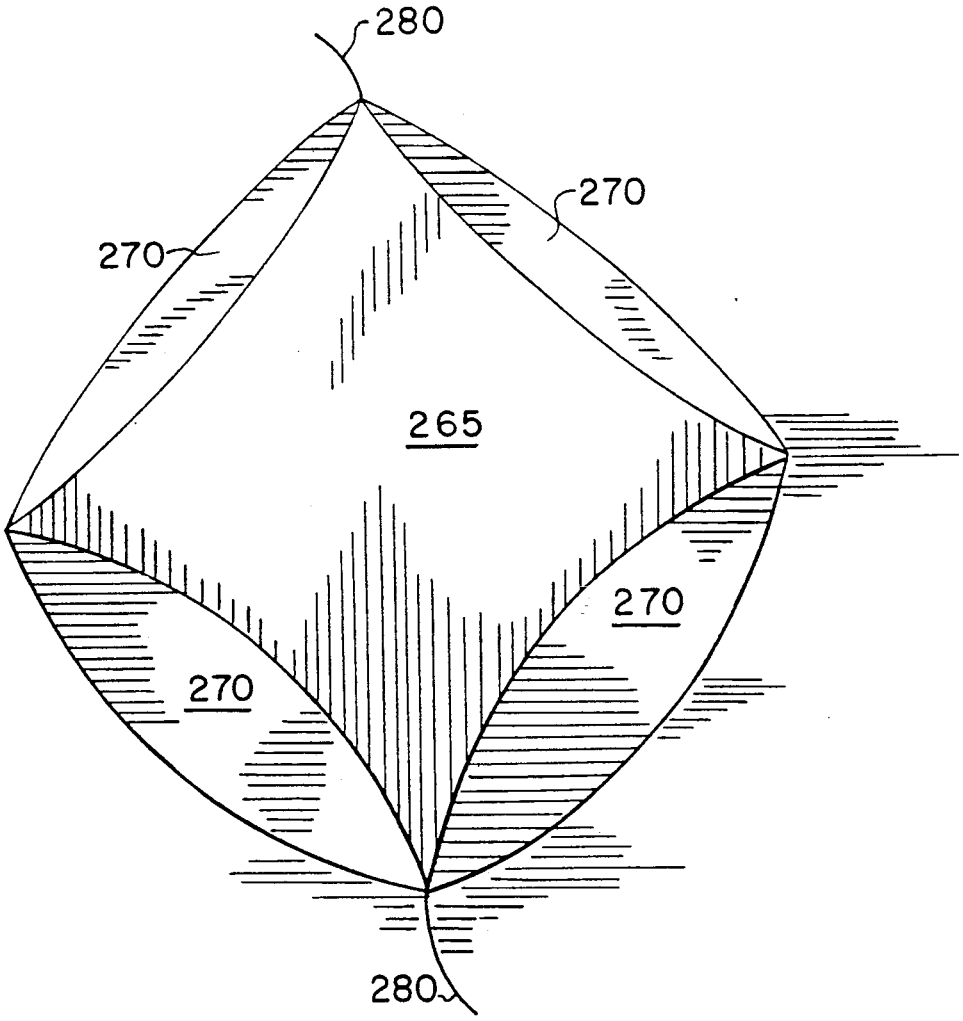
FIG. 9 is a perspective view of a different block component which is usable according to the invention.

FIG. 9 illustrates yet another shape which has utility in the present invention. This box 260 includes identically sized quadrilateral front 265 and back faces with inwardly extending sides 270. Again, the connecting element 280 passes through opposite corners of box 260 for connection to adjacent objects. Thus, in accordance with the preceding, this box 260 can be rotated so that the front and back faces can be exchanged to change the appearance of the overall combination.

A wide variety of other shapes and sizes of objects can also be made into the combination of the invention with the overall size of the combination limited only by the imagination of the user. Preferably, polyhedrons having four fold symmetry, such as cubes and the like, are preferred for use in the invention since the number of rotatable shapes presented can be more easily varied. However, in accordance with the previous teachings herein, it is possible for any three dimensional object or combination thereof, to be utilized in the present invention.

While it is apparent that the invention herein disclosed fulfills the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A transformable combination including a first set of polyhedrons comprising:

a plurality of polyhedrons including at least first and second polyhedrons each having a top face edges, a bottom face and a plurality of concave sides; and means for connecting adjacent corners of each of said polyhedrons in a manner which allows rotation of the faces, edges, and sides of one polyhedron relative to an adjacent polyhedron, wherein said polyhedron has no more than one additional connection to any other polyhedron in the set and said means for connecting connecting said first and a last polyhedron thereby creating a closed set.

2. The combination of claim 1 wherein each said polyhedron has a number of sides equal to a multiple of 4.

3. The combination of claim 1 wherein each concave side has a shape defined by two circles which intersect each other at the end points of a side of the polyhedron, each of said circles having a radius equal to the length of the side of the polyhedron which it intersects.

4. A transformable combination including a first set of objects comprising:

a first object having multiple faces and edges;

a second object having multiple faces and edges;

means for connecting corners of said first and second objects in a manner which allows rotation of said first object relative to said second object so that the position of said faces and edges of said first object can be changed with respect to those of said second object; and a plurality of additional objects including:

a third object having multiple faces and edges;

means for connecting corners of said third object to said second object in a manner which allows rotation of said second object relative to said third object so that the position of said faces and edges of said second object can be changed with respect to those of said third object;

a fourth object having multiple faces and edges;

means for connecting corners of said fourth object to said third object in a manner which allows rotation of said third object relative to said fourth object so that the position of said faces and edges of said third object can be changed with respect to those of said fourth object; and means for connecting said fourth object to said first object in a manner which allows rotation of said fourth object relative to said first object so that the position of said faces and edges of said fourth object to be changed with respect to those of the first object;

wherein each of said corner connection means acts upon the corners of said objects to allow relative rotation of the respective faces and edges, and further wherein each of said objects have no more than one additional connection to any other object in the set.

5. The combination of claim 4 wherein each of said objects is connected by a continuous element.

6. The combination of claim 5 wherein said continuous element is a resilient filament which allows the spacing between adjacent objects to be increased by stretching of said filament.

7. The combination of claim 5 wherein said continuous element is a filament which includes means for elongating said continuous element to increase the spacing between adjacent objects.

8. The combination of claim 7 wherein said elongating means comprises a spring located in at least one of said objects.

9. The combination of claim 4 wherein at least one of said connecting means comprises a rod member having first and second ends of larger cross-sectional area than said rod member, said first and second ends respectively positioned within adjacent objects.

10. The combination of claim 4 wherein said first and second objects each have first, second and third outer faces and further wherein the position of said faces of said second object can be changed with respect to the position of the faces of the first object.

11. The combination of claim 4 wherein each of said first and second objects is a three dimensional polyhedron.

12. The combination of claim 11 wherein said first and second objects are connected at a corner of each polyhedron.

13. The combination of claim 4 wherein each of said first and second objects is a cube.

14. The combination of claim 13 wherein said first and second objects are connected at a corner of each cube.

15. The combination of claim 14 wherein said connecting means extends diagonally through each cube.

16. The combination of claim 4 wherein each of said first and second objects is a polyhedron.

17. The combination of claim 16 wherein each said polyhedron has at least six faces.

18. The combination of claim 16 where each said polyhedron is symmetrical to each other polyhedron.

19. The combination of claim 4 wherein each of said objects is a cube, and wherein each connection means extends through the corners of adjacent cubes and comprises a rod member having first and second ends of larger cross-sectional area than said rod member, said first and second ends respectively positioned within the corners of said adjacent cubes.

20. A transformable combination including a first set of objects comprising:

a first object having multiple faces and edges;

a second object having multiple faces and edges;

means for connecting said first and second objects in a manner which allows rotation of said first object relative to said second object so that the position of said faces and edges of said first object can be changed with respect to those of the second object;

a third object having multiple faces and edges and being positioned adjacent said second object;

means for connecting said third object to said second object in a manner which allows rotation of said second object relative to said third object so that the position of said faces and edges of said second object can be changed with respect to those of the third object;

a fourth object having multiple faces and edges and being positioned adjacent said third object;

means for connecting said fourth object to said third object in a manner which allows rotation of said third object relative to said fourth object so that the position of said faces and edges of said third object can be changed with respect to those of the fourth object; and means for connecting said fourth object to said first object in a manner which allows rotation of said fourth object relative to said first object so that the position of said faces and edges of said fourth object can be changed with respect to those of the first object;

wherein each of said connection means acts upon the corners of said objects to allow relative rotation of the respective faces and edges and further when each of said objects has no more than one connection to any other object in the set.

21. The combination of claim 20 which further comprises a second set of first, second, third and fourth objects connected in the same manner as the objects of the first set and further wherein at least one object of the first set is connected to an object of the second set.

22. The combination of claim 20 wherein at least one of said connector means comprises an elongated rod member having first and second ends and means for forming first and second end members each having a larger cross sectional area than said rod member and positioned at and associated with said first and second ends, respectively, of said rod member for joining adjacent objects and allowing rotation therebetween, wherein said rod member extends through an aperture in a corner of each of said adjacent objects and the first and second end members are capable of rotation about said rod member.

23. The combination of claim 22 wherein the first and second end members are spherical, the rod member is configured to form a predetermined acute angle, and the end retaining means includes a stop member.

24. A transformable combination including a first set of objects comprising:

first, second, third and fourth three dimensional polyhedrons each having multiple faces, edges, corners and sides; and means connecting each of said polyhedrons at a first corner and extending therethrough to an opposite corner so that the faces, sides and edges of each polyhedron can be rotated with respect to those of adjacent polyhedrons to change the position of the faces, sides and edges of the rotated polyhedron;

wherein each polyhedron has no more than one connection to any other object or polyhedron in the set and the first and last polyhedrons connected to each other by said connecting means to form a closed set.

25. The combination of claim 24 wherein each of said objects are connected by a continuous element.

26. The combination of claim 25 wherein said continuous element is a filament which includes means for elongating said continuous filament to increase the spacing between adjacent objects.

27. The combination of claim 24 wherein at least one of said connector means comprises an elongated rod member having first and second ends and means for forming first and second end members each having a larger cross sectional area than said rod member and positioned at and associated with said first and second ends, respectively, of said rod member for joining adjacent objects and allowing rotation therebetween, wherein said rod member extends through an aperture in a corner of each of said adjacent objects and the first and second end members are capable of rotation about said rod member.

28. The combination of claim 27 wherein the first and second end members are spherical, the rod member is configured to form a predetermined acute angle, and the end retaining means includes a stop member.

29. A connector joining two adjacent three dimensional objects and allowing relative rotation therebetween comprising an elongated rod member having first and second ends; and retention means comprising first and second end members each having a larger cross-sectional area than said rod member and positioned around said rod and each associated with said first and second ends, respectively, of said rod member, and joining the adjacent three dimensional objects and allowing rotation therebetween said retention means being retained upon the rod member by rod end stop means; said rod member extending through an aperture in a corner of each of said adjacent three dimensional objects with said first and second end members and said retention means retaining said adjacent objects in adjacent rotatable relation thereby; wherein said first and second end members with said objects are capable of rotation about said rod member.

30. The connector of claim 29 wherein said first and second end members are spherical.

31. A combination comprising a plurality of three dimensional objects wherein each pair of adjacent objects is connected by the connector of claim 30, wherein said first and second end members are respectively located within said adjacent objects and the rod member extends through a corner of each object.

32. The connector of claim 29 where said rod member is configured to form a predetermined acute angle.

33. A combination comprising a plurality of three dimensional objects wherein each pair of adjacent objects is connected by the connector of claim 32, wherein said first and second end members are located within said adjacent objects and the rod member extends through a corner of each object.

34. A combination comprising the connector of claim 29 and first and second three dimensional objects connected therebetween, wherein said first and second end members are located within said first and second three dimensional objects, respectively, and said rod member extends through a corner aperture in each object.

35. A combination comprising a plurality of three dimensional objects wherein each pair of adjacent objects is connected by the connector of claim 29, wherein said first and second end members are respectively located within said adjacent objects and the rod member extends through a corner of each object.

* * * * *